US009388800B2

(12) United States Patent
Gerz et al.

(10) Patent No.: US 9,388,800 B2
(45) Date of Patent: Jul. 12, 2016

(54) DOSING PUMP ARRANGEMENT

(75) Inventors: Sergei Gerz, Pfinztal (DE); Klaus Müller, Karlsruhe (DE); Bernd Rosner, Schömberg (DE)

(73) Assignee: Grundfos Management a/s, Bjerringbro (DK)

( * ) Notice: Subject to any disclaimer, the term of this patent is extended or adjusted under 35 U.S.C. 154(b) by 399 days.

(21) Appl. No.: 13/808,762

(22) PCT Filed: Jul. 6, 2011

(86) PCT No.: PCT/EP2011/003355
§ 371 (c)(1),
(2), (4) Date: Mar. 21, 2013

(87) PCT Pub. No.: WO2012/003976
PCT Pub. Date: Jan. 12, 2012

(65) Prior Publication Data

US 2013/0177462 A1 Jul. 11, 2013

(30) Foreign Application Priority Data

Jul. 9, 2010 (EP) ..... 10007087

(51) Int. Cl.
*F04B 19/00* (2006.01)
*F04B 1/00* (2006.01)
*F04B 1/04* (2006.01)
(Continued)

(52) U.S. Cl.
CPC ..... *F04B 1/00* (2013.01); *F04B 1/0404* (2013.01); *F04B 1/0426* (2013.01); *F04B 9/02* (2013.01); *F04B 13/00* (2013.01)

(58) Field of Classification Search
CPC ..... F04B 9/02; F04B 13/00; F04B 1/00; F04B 1/0426; F04B 1/0404
USPC ..... 417/413.1, 470, 471
See application file for complete search history.

(56) References Cited

U.S. PATENT DOCUMENTS 3,314,365 A * 4/1967 Ritchie ..... F04B 9/045 417/471
3,381,591 A * 5/1968 Toschkoff ..... F02M 1/00 417/471

(Continued)

FOREIGN PATENT DOCUMENTS

CN 201060011 Y 5/2008
DE 196 23 537 * 12/1997

(Continued)

OTHER PUBLICATIONS

Office Action issued Oct. 21, 2014 in JP Application No. 2013-518978.

(Continued)

*Primary Examiner* — Charles Freay
(74) *Attorney, Agent, or Firm* — Panitch Schwarze Belisario & Nadel LLP

(57) ABSTRACT

A metering pump assembly includes a metering space (6) and a displacement body (8) which is linearly movable via a conrod (10). A helical spring (20) designed as a compression spring (20) impinges the conrod (10) with a force in a movement direction. The helical spring (20) at at least one axial end (24) is designed such that in a relaxed condition an end (26) of a spring wire projects axially with respect to a connecting winding (28).

7 Claims, 2 Drawing Sheets

(51) Int. Cl.
*F04B 13/00* (2006.01)
*F04B 9/02* (2006.01)

(56) References Cited

U.S. PATENT DOCUMENTS

| | | | | | |
|---|---|---|---|---|---|
| 3,799,704 | A * | 3/1974 | Kuck | F04B 9/02 | 15/250.02 |
| 4,104,008 | A | 8/1978 | Hoffmann et al. | | |
| 4,621,990 | A | 11/1986 | Forsythe et al. | | |
| 6,089,141 | A * | 7/2000 | Okesaku | F04B 9/06 | 417/471 |
| 6,655,933 | B2 * | 12/2003 | Chiba | F04B 1/0426 | 417/470 |
| 2004/0156733 | A1 * | 8/2004 | Spinnler | 417/470 | |
| 2005/0238506 | A1 * | 10/2005 | Mescher et al. | 417/413.1 | |
| 2008/0138215 | A1 | 6/2008 | Jochumsen et al. | | |

FOREIGN PATENT DOCUMENTS

| | | | |
|---|---|---|---|
| EP | 1676988 | A1 | 7/2006 |
| FR | 2355180 | A1 | 1/1978 |
| JP | H05-288207 | A | 11/1993 |
| JP | H10-281197 | A | 10/1998 |
| JP | H10-299643 | A | 11/1998 |
| JP | 2008-045441 | A | 2/2008 |
| WO | 0133133 | A1 | 5/2001 |
| WO | 2007057846 | A2 | 5/2007 |

OTHER PUBLICATIONS

Int'l Search Report issued Feb. 13, 2013 in Int'l Application No. PCT/EP2011/003355.
Office Action issued Jan. 14, 2015 in CN Application No. 201180033799.9.
Office Action issued Aug. 4, 2015 in JP 2013-518978.

* cited by examiner

DOSING PUMP ARRANGEMENT

CROSS-REFERENCE TO RELATED APPLICATIONS

This application is a Section 371/Continuation of International Application No. PCT/EP2011/003355, filed Jul. 6, 2011, which was published in the German language on Jan. 21, 2012, under International Publication No. WO 2012/003976 A2 and the disclosure of which is incorporated herein by reference.

BACKGROUND OF THE INVENTION

The present invention relates generally to a metering or dosing pump assembly.

Metering pump assemblies are known, which include a metering space and a displacement body, for example in the form of a membrane, which is adjacent this metering space. This displacement body is linearly moved via a conrod. With such known metering pump assemblies, the conrod is moved via an electrical drive motor, in particular a stepper motor. Moreover, a compression spring as spring storage means acts on the conrod. With the known metering pump assemblies, it is thereby difficult to assemble the conrod and spring, since the spring, given a compression, can lead to an oblique position of the conrod due to occurring side forces, which in turn leads to side forces on the membrane, with a more rapid wear of the membrane on account of this. For this reason, adjustment screws are provided with known designs, in order to be able to correct the conrod alignment. However, the complete design and assembly becomes more complicated due to this.

BRIEF SUMMARY OF THE INVENTION

It is therefore an objective of a preferred embodiment of the present invention to provide an improved metering pump assembly with a displacement body driven via a conrod and with a spring storage means, which has a simplified construction, is simpler to assembly and thereby permits a long-term reliable operation of the pump assembly.

The above objective is achieved by a metering pump assembly with a metering space and with a displacement body which is linearly movable via a conrod. Preferred embodiments are to be deduced from the dependent claims, the subsequent description, as well as the attached figures.

As with known metering pump assemblies, the metering pump assembly according to a preferred embodiment of the present invention includes a metering space, whose volume is changeable by way of a displacement body which is adjacent the metering space or is arranged in the metering space. This displacement body can for example be a membrane which forms a side wall of the metering space. The displacement body is linearly moveable via a conrod which for its part, as the case may be via a gear, is set into movement by a rotating drive motor. Moreover, a helical spring designed as a compression spring acts on the conrod and the displacement body. This forms a spring storage means which stores energy in a travel direction, in order to then release this in another travel direction. Thus, the spring for example is compressed in the intake or suction stroke and then releases its energy again with the compression stroke by way of relaxation. In this manner, the helical spring impinges the conrod in a movement direction, preferably the movement direction for the compression stroke, with an additional force.

According to a preferred embodiment of the present invention, the helical spring is designed such that it has no closed spring end at at least one axial end in the relaxed condition. For example, the free end of the helical sprung is not closed onto the following winding. In contrast, according to a preferred embodiment of the present invention, one envisages the end of the spring wire projecting axially with respect to the connecting winding, for example being distanced, at at least one axial end in the relaxed condition. Until now, it was usual to shape helical springs for the mentioned application purpose at their ends such that the free end is closed onto the wire of the adjacent neighboring winding. Now, according to a preferred embodiment of the present invention, one departs from this design. In contrast, according to a preferred embodiment of the present invention, the spring wire at at least one axial end is cut to length such that the last winding also runs helically up to the axial end of the spring wire, and the end of the spring wire at the axial end projects axially with respect to the connecting winding. In order despite this to create a plane contact surface, which extends normally to the spring longitudinal axis, the spring wire is ground adjacent the axial end. The thus a ground surface extends normally to the spring longitudinal axis. Thus, a plane contact surface is created, which preferably extends over an angle region or peripheral region of 200° to 300° about the longitudinal axis of the spring. This non-closing design of the spring end has the advantage that with a compression of the spring, lower or no side forces occur, which would lead to an oblique positioning of the conrod and thus to an undesired lateral loading of the displacement body, in particular of a membrane. Thus one can make do without additional adjustment disks and the assembly is significantly simplified. Simultaneously, however, the undesired lateral loading on the displacement body, for example on the membrane, is reduced, by which means the service life of the membrane is increased.

Preferably, the helical spring is designed in the described manner at both axial ends which are opposite to one another, for example are designed such that in the relaxed condition, the end of the spring wire projects axially with respect to the connecting winding, for example is not closed. In this manner, undesired side forces or transverse forces normal to the spring longitudinal axis are avoided. The described ground contact surface is preferably also designed at both axial ends.

According to a further preferred embodiment of the present invention, the ends of the spring wire at both axial ends of the helical spring are situated at the same angular position with respect to the longitudinal axis of the helical spring. For example, the axial ends at both ends lie on the same line or an imagined axis parallel to the spring longitudinal axis. The two axial ends of the spring wire, preferably the ends which project in the axial direction with respect to the adjacent winding, thus lie at the same peripheral position. By way of this design too, an optimal force transmission is achieved without the undesired transverse or side forces.

According to a further preferred embodiment of the present invention, the helical spring at at least one axial end has an end configuration which is only produced by the cutting to length of the spring wire. For example, here the spring wire is simply cut off, without a further special shaping or forming being effected. However, it is preferably to machine the region which is directly adjacent the end of the spring wire, as described above, by way of grinding for example, in order there to form a plane contact surface transversely or at right angles to the spring longitudinal axis. The spring wire thereby is ground such that a plane contact surface is created, which in the relaxed condition of the compression spring extends transversely, for example essentially normally to the spring longitudinal axis and runs over more than one quarter, preferably over 50% to 90%, further preferably 55% and 85% of the periphery with respect to the spring longitudinal axis.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
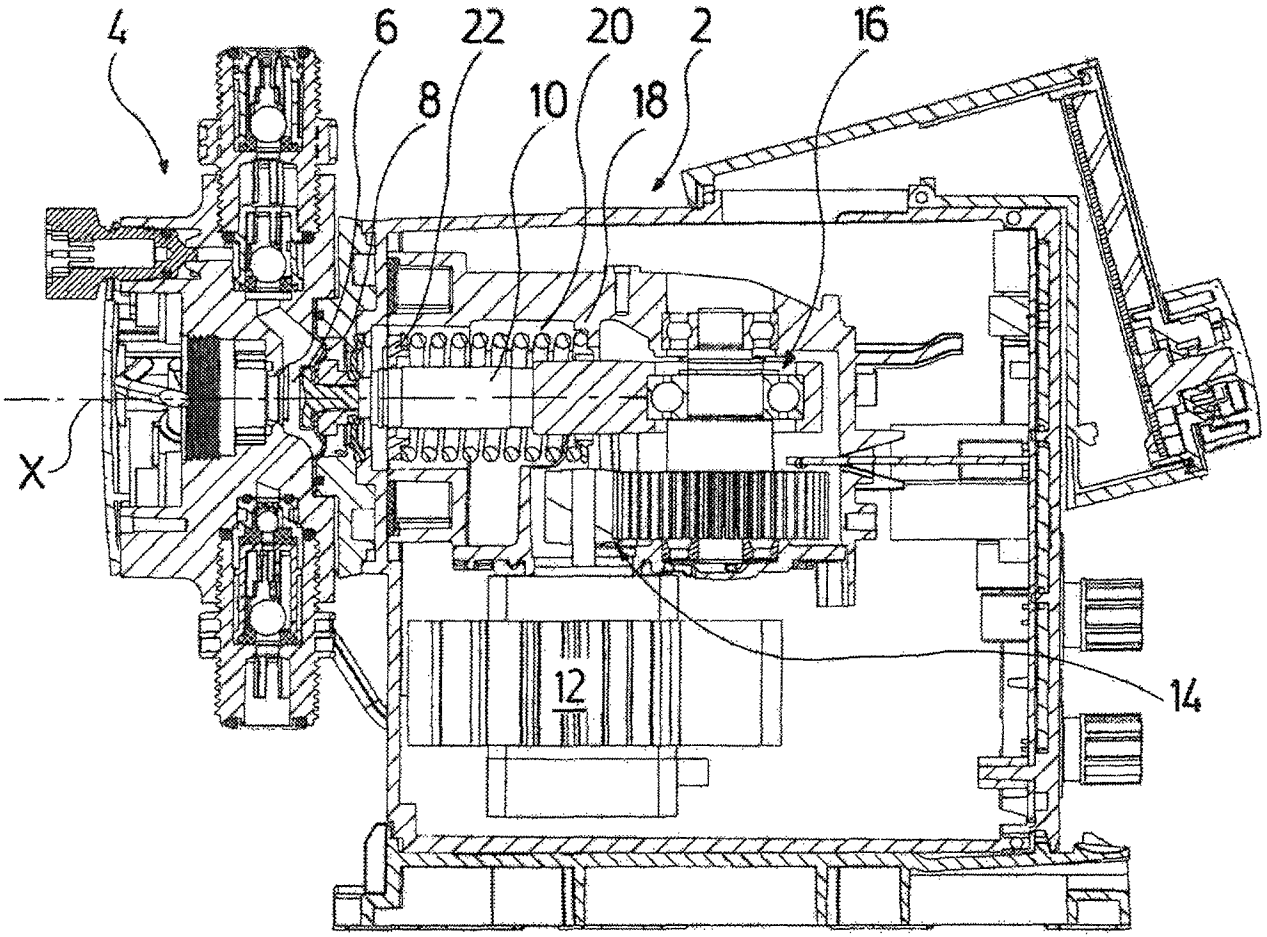
FIG. 1 is a cross-sectional view of an entire metering pump assembly according to a preferred embodiment of the present invention.

Certain terminology is used in the following description for convenience only and is not limiting. The words "right," "lower" and "front" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import.

Figure 2:
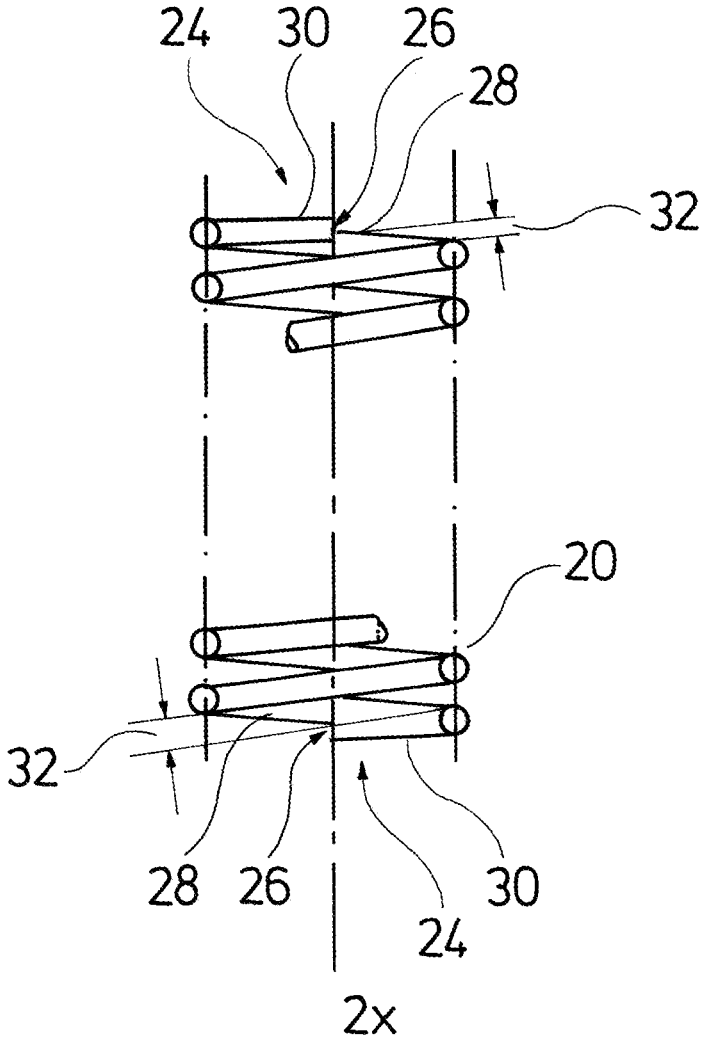
FIG. 2 is a schematic view of a the compression spring used as a spring storage means in the metering pump assembly.

Referring to the drawings in detail, wherein like numerals indicate like elements throughout the several views, FIGS. 1-2 illustrate a metering pump assembly according to a preferred embodiment of the present invention that includes a drive housing 2, in which the drive described later in more detail is arranged, and onto which a pump head 4 is applied at one side. A metering space 6 is formed in the pump head 4 and is delimited on one side surface by a membrane 8 which serves as a displacement body. The membrane 8 is driven via a conrod which extends through the sealing of the drive housing, i.e. is moved linearly to and from along the movement axis X. For this, an electronic drive motor 12 is provided, which for example can be designed as a stepper motor. The rotating drive motor 12 via a cog gear 14 and an eccentric 16 sets the conrod 10 into the desired linearly oscillating movement.

A compression spring 20 as a spring storage means is arranged between the front end of the conrod, for example the end of the conrod which faces the membrane, and a carrier 18 connected to the housing. The compression spring 20 is designed as a helical spring and with its end which is away from the membrane 8 is supported on a contact surface of the carrier 18 and with the opposite end on a contact disk 22 connected to the conrod 10. Thus, the compression spring 20 is arranged such that it is compressed in the suction stroke, i.e. when the conrod 10 is retracted and is moved away from the metering space 6, and is relaxed in the subsequent compression stroke, when the conrod 10 is moved towards the metering space 6 and the membrane 8 is pressed in the metering space 6. Thus the compression spring 20 in the suction stroke absorbs energy which it then releases in the compression stroke as additionally pump energy via the conrod 10 onto the membrane 8.

The design of the compression spring 20 is explained in more detail by way of FIG. 2. The compression spring 20 is enlarged in its relaxed condition in FIG. 2. One can recognize that the ends 26 of the spring wire at both axial ends 24 are designed such that they project in the axial direction X beyond the connecting winding 28. For example, the spring ends or the ends of the spring wire 26 are not closed onto the last winding 28. In contrast, the ends 26 of the spring wire essentially are simply cut to length, without a special further deformation of the axial end of the spring having been effected. Finally, the last section 30 of the winding 28 which is adjacent the end of the spring wire 26 is machined or ground such that a plane contact surface is created, which extends normally to the longitudinal axis X. This section 30, however, does not extend over the whole periphery with respect to the longitudinal axis X, but only over a peripheral section between 50% and 90% of the periphery, preferably over an angular region between 200° and 300°.

Moreover, the ends 26 of the spring wire lie at the same angle with respect to the longitudinal axis X, i.e. on a line or imagined axis parallel to the longitudinal axis X, in the same peripheral region. On installing the compression spring 20 into the metering pump assembly shown in FIG. 1, due to this positioning of the two ends 26 and the distance 32 of the ends 26 to the connecting winding 28, one succeeds in no undesired transverse or side forces occurring on compression of the compression spring 20, which would lead to a lateral deflection of the conrod and thus to a transverse loading of the membrane.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A metering pump assembly comprises: a metering space (6);

a displacement body (8) linearly movable via a conrod (10), wherein the displacement body (8) comprises a membrane which forms a side wall of the metering space (6); a drive housing containing a drive motor (12) to drive the conrod: and a helical spring (20) designed as a compression spring (20) which impinges the conrod (10) with a force in a movement direction, wherein the compression spring is arranged such that it is compressed in a suction stroke of the metering pump when the conrod is retracted and moved away from the metering space and is relaxed in a compression stroke of the metering pump when the conrod is moved toward the metering space and the membrane is pressed in the metering space, wherein the compression spring is located inside the drive housing between the drive motor and a sealing of the drive housing, and wherein the helical spring (20) at at least one axial end (24) thereof is designed such that in a relaxed condition an end (26) of a spring wire projects axially with respect to a connecting winding (28).

2. The metering pump assembly according to claim 1, wherein the helical spring (20) at both axial ends which are opposite to one another is designed such that in the relaxed condition the end (26) of the spring wire projects axially with respect to the connecting winding (28).

3. The metering pump assembly according to claim 2, wherein the ends (26) of the spring wire at both axial ends (24) of the helical spring (20) are situated at the same angular position with respect to a longitudinal axis (X) of the helical spring (20).

4. The metering pump according to claim 1, wherein the helical spring (20) at at least the one axial end (24) has an end configuration which is only produced by way of cutting the spring wire to length.

5. The metering pump assembly according to claim 1, wherein the helical spring (20) at at least the one axial end (24) comprises a ground contact surface which is adjacent to the axial end.

6. The metering pump assembly according to claim 5, wherein the ground contact surface in the relaxed condition of the helical spring (20) extends normally to a longitudinal axis of the helical spring (20).

7. The metering pump assembly according to claim 1, wherein the conrod is connected with the membrane for linear movement thereof, and wherein the conrod is driven by a rotating drive motor (12) via an eccentric (16).

* * * * *